United States Patent [19]

Totten

[11] Patent Number: 4,613,929

[45] Date of Patent: Sep. 23, 1986

[54] RETROFIT LOUVRE FOR LIGHTING FIXTURE

[76] Inventor: Thomas B. Totten, R.R. #4, Stouffville, Ontario, Canada, L0H 1L0

[21] Appl. No.: 628,221

[22] Filed: Jul. 6, 1984

[51] Int. Cl.[4] ..... F21S 1/02

[52] U.S. Cl. ..... 362/150; 362/148; 362/404; 362/354

[58] Field of Search ..... 362/148, 150, 404, 354

[56] References Cited

U.S. PATENT DOCUMENTS

| | | | |
|---|---|---|---|
| 2,559,640 | 7/1951 | Kruger . | |
| 3,052,372 | 9/1962 | Shepherd . | |
| 3,081,398 | 3/1963 | Karth | 362/150 |
| 3,446,955 | 5/1969 | Bailey et al. . | |
| 3,816,880 | 6/1974 | Jacobs | 362/150 |
| 3,863,251 | 7/1951 | Gould et al. . | |
| 4,175,281 | 11/1979 | Lonseth | 362/148 |
| 4,272,804 | 6/1981 | Blum | 362/148 |

FOREIGN PATENT DOCUMENTS

| | | | |
|---|---|---|---|
| 672451 | 10/1963 | Canada | 362/148 |

*Primary Examiner*—Ira S. Lazarus

*Attorney, Agent, or Firm*—George A. Rolston

[57] ABSTRACT

A troffer extension attachable to the walls of a lighting troffer, and with portions of a ceiling to raise the troffer relative to the ceiling, and having extension members, upper devices on one end of the members for engaging the troffer, and, lower devices on the other ends of the members for engaging the ceiling.

3 Claims, 5 Drawing Figures

RETROFIT LOUVRE FOR LIGHTING FIXTURE

The invention relates to lighting fixtures, and in particular to rectangular lighting troffers of the type using elongated fluorescent tubes.

Lighting troffers are customarily installed in socalled "dropped ceilings", for illuminating office space, industrial, institutional or commercial space. These installations should preferably meet a variety of exacting specifications. In particular, it is desirable as far as possible to reduce glare. Glare may be defined as the low angle light rays which are directly visible to a person seated or standing in the work space.

Such glare is irritating to persons in the work space and may in some cases interfere with their work, or at least cause irritation.

It is highly desirable to mask the troffers in some way so as to cut out the escape of low angle light rays. As far as possible the light rays from each troffer should be directed downwardly, within a predetermined pattern beneath each troffer.

Persons in the work space will not be affected by glare from light troffers directly overhead since they will seldom look straight up.

Various solutions have been proposed to the problem of glare.

In some more costly ceiling systems, rectangular recesses are formed in the ceiling at spaced intervals, such rectangular recesses being known as "coffers".

The lighting fixtures are installed in the upper wall of such coffers, so that in effect the side walls of the coffer form a mask or blind around each lighting fixture which cuts off the escape of low angle light rays.

This solution is however relatively costly, and may also be impossible due to the architecture and engineering of the building and the floor platforms from which the ceilings are hung.

Generally speaking, lighting troffers are made in such a way as to occupy as little vertical space as possible, and are consequently usually designed as relatively shallow inverted rectangular boxes.

However, when used in a coffered ceiling, even the relatively shallow standard type of lighting troffer may occupy too much dead space within the ceiling area.

Consequently, this solution is not always acceptable.

Another solution has been the development of a lighting troffer box of somewhat deeper dimensions. The side walls of the troffer box being somewhat deeper, will thus locate the lighting tubes themselves somewhat higher relative to the plane of the ceiling, leaving a dead space between the tubes and the plane of the ceiling.

This dead space is not as great as the dead space provided in the coffer type of ceiling, and consequently is not effective to cut off all low angle light rays escaping from the tubes.

In order therefore to still further reduce glare, a form of lighting screen or baffle known as a "louvre" is used. The louvre is essentially a series of longitudinal and lateral metal strips interlocked in egg-crate fashion, defining a series of equally sized rectangular or square openings. The louvre is placed in the dead space beneath the lighting tubes, and has a lower edge which is generally flush with the plane of the ceiling.

The louvre effectively cuts off the escape of low angle light rays and prevents glare. It also provides a pleasing decorative touch to the lighting fixtures, and improves the aesthetic appearance of the ceiling.

In order to utilize such louvres however it is necessary to first of all install the deeper lighting troffer boxes themselves.

In the great majority of lighting installation, the original equipment installed by the contractor is of the standard shallow troffer box design.

If the owner or occupier of a building wishes to "upgrade" to louvred lighting fixtures, then it is necessary to buy and install a complete new set of the deeper troffer boxes, and remove and discard the old ones This can represent a very considerable investment.

Clearly, it would be desirable if the existing standard shallow type troffer boxes could be adapted or modified in some way so as to accommodate the louvres, and thus improve the appearance of the ceiling and the lighting fixtures and also cut out glare.

BRIEF SUMMARY OF THE INVENTION

With a view to overcoming these various problems, the invention comprises a troffer extension device, attachable to the side and end walls of a troffer, and interengagable with structural portions of a ceiling system, whereby to raise the troffer side walls relative to the ceiling, and having a plurality of extension members, upper engagement means on one end of said members for engaging the said lighting troffer, and lower engagement means on the other ends of said members for engaging said ceiling structure.

More particularly, the invention seeks to provide such a troffer extension apparatus, wherein said upper engagement means are adapted to fit around and interengage with the lower edge of said troffer side walls, and wherein said ceiling structure comprises ceiling tees, and wherein said lower engagement means comprises clip portions engageable around upwardly directed portions of said ceiling tees, and including fastening means for fastening the same together.

It is a further and related objective of the invention to provide a lighting louvre dimensioned to fit within the dead space provided by the extension members of the invention, and including releasable clip members on said louvres, whereby the same may be releasably fastened in position.

It is a further and related objective of the invention to provide such troffer extension apparatus wherein said extension members comprise a plurality of separate members adapted to be placed at spaced locations around said troffer side walls.

More particularly, it is an objective of the invention to provide such a troffer extension apparatus wherein the extension members comprise side and end walls forming a continuous rectangular framework, adapted to be placed between said troffer side walls and said ceiling structure and completely enclosing the dead space provided thereby on all four sides.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
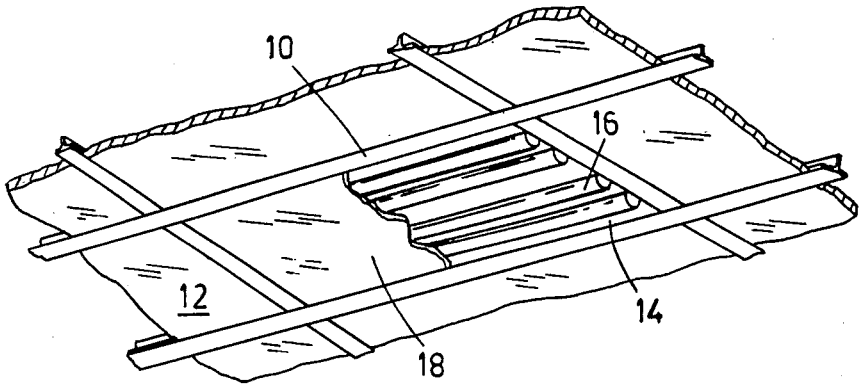
FIG. 1 is a lower perspective illustration of a typical ceiling, partially cut away and revealing and lighting troffer and troffer extension apparatus according to the invention.

As shown in FIG. 1, the invention is applicable to a typical dropped ceiling. Such a ceiling is essentially hung from the floor slab immediately above it, or from the roof joists in the top floor of a building.

It comprises a generally rectangular framework or grid of ceiling tees 10, arranged in any suitable modular pattern. Typically the pattern defines rectangular openings which are 4 ft.×2 ft. Ceiling modules vary widely however from one system to another and the invention is not restricted to any particular form of ceiling.

Within the ceiling tees, acoustic panels 12 are supported, and, at spaced intervals across the ceiling, lighting fixtures or troffers 14 are supported on the ceiling tees. Other service fixtures such as air handling fixtures, speaker systems, and the like may be supported on the ceiling, although they are omitted for the sake of clarity.

The space between the ceiling and the floor from which it is hung is generally used for the installation of various service raceway ducts and the like, and essentially constitutes dead space or waste space in the overall structure of the building. As such, it is generally desirable to reduce such dead space to a minimum.

As has been noted above, the most widely used form of troffer 14 is a relatively shallow opensided rectangular box with the open side directed downwardly. Lighting tubes such as 16 are installed within the troffer 14, and are supplied with electrical power from a suitable supply circuit (not shown), the details of which are well known.

A lens, a portion of which is shown as 18, covers the lower open side of the troffer 14. The lens is typically made of an appropriate translucent or transparent plastic material. Its purpose is to provide a soft even lighting. Usually the surface of the lens on one or both sides has a predetermined contour in a prismatic formation, designed to diffuse and break up the light so as to as far as possible provide even lighting.

It will of course be well understood that in a typical ceiling such as that illustrated in FIG. 1, light rays will escape from the troffer 14 at a relatively low angle. Consequently persons walking about or seated in the space, will be subject to the irritating effect of direct light rays from such light troffers.

Figure 2:
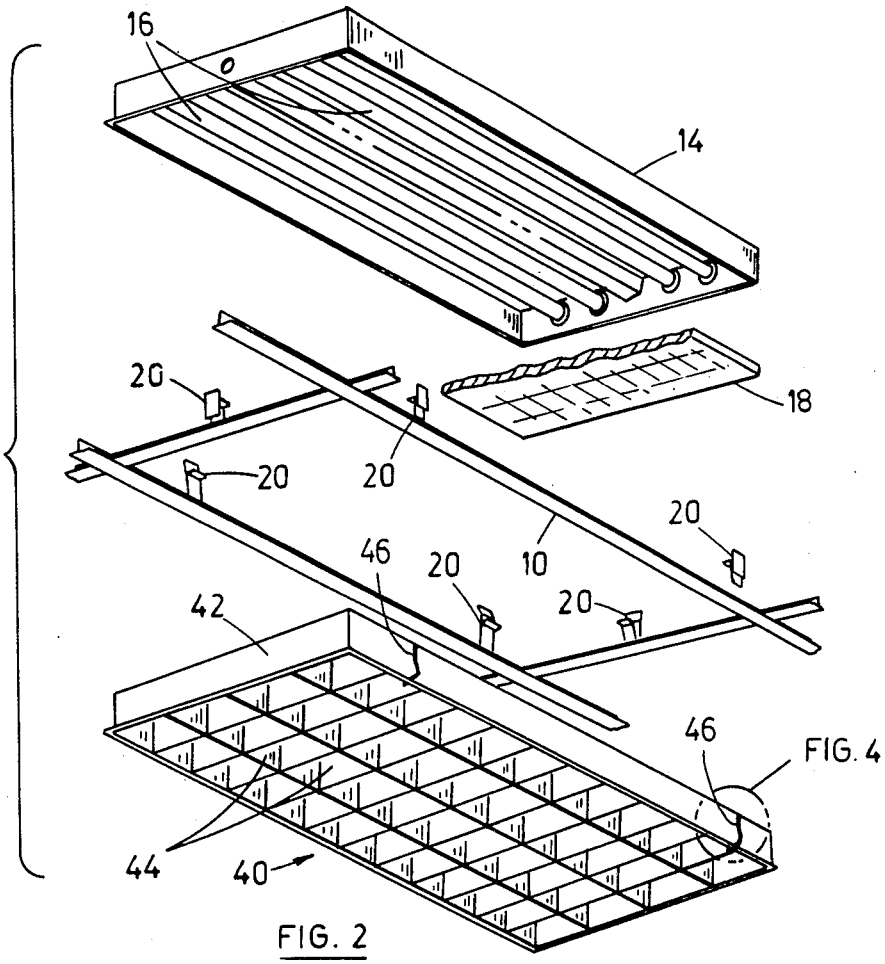
FIG. 2 is an exploded perspective illustration of the troffer and extension apparatus of FIG. 1.
Figure 3:
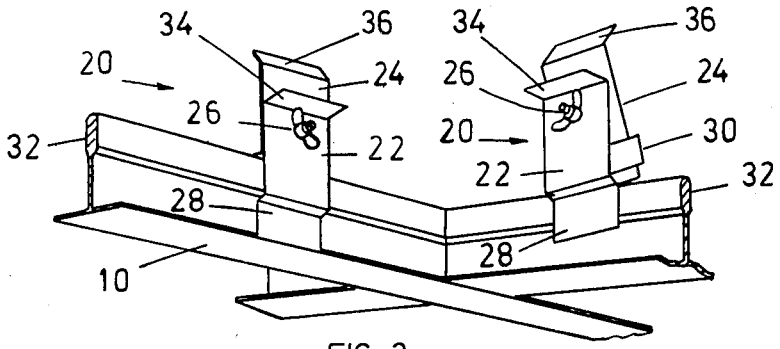
FIG. 3 is an enlarged perspective of a detail of FIG. 2.
Figure 4:
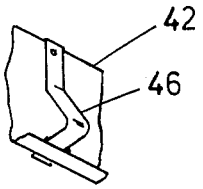
FIG. 4 is an enlarged perspective of a detail of FIG. 2.

Such glare may be overcome in accordance with the invention one form of which is shown in FIGS. 2, 3 and 4.

As shown in FIGS. 2, 3 and 4, the same lighting troffer 14 with tube 16 and lens 18 are employed, but in this case they are raised upwardly somewhat higher into the dead space between the ceiling and the floor above, by means of a plurality of troffer extension assemblies indicated generally as 20.

As shown in more detail in FIGS. 3 and 4, each of the troffer extension assemblies comprise is of generally two-part construction, and comprises an inner panel 22 and an outer panel 24, held together by means of a bolt and wing nut 26 passing through suitable openings in the panels 22 and 24.

The panels 22 are provided at their lower ends with offset clamp portions 28, and the panels 24 are also provided with offset clamping channels 30.

The clamping portions 28 and 30 fit around a typical rib portion 32 provided along the upper edge of the conventional ceiling tee 10.

The panels 22 have at their upper ends internal support flanges 34, and the panels 24 are designed to extend somewhat above the support flanges 34, and are provided with generally upwardly angled guide flanges 36.

As best shown in FIG. 2, a plurality in this case six such assemblies 20 can be mounted on the upper ribs 32 of the ceiling tees 10. The lower open side of the troffer 14 can then simply be rested on the support flanges 34. The guidance flanges 36 and the outer panels 24 serve to locate and centre the troffer 14 so that it cannot move to one side of the support flanges 34.

It will thus be seen that by this means the troffers 14 can be raised upwardly relative to the ceiling tees 10.

It will of course be appreciated that the extension assemblies may conceivably be made as continuous walls, around all four sides of the troffer 14. Indeed in some jurisdictions local laws or building regulations may require such a complete enclosure, although in the majority of cases this would not be necessary.

Figure 5:
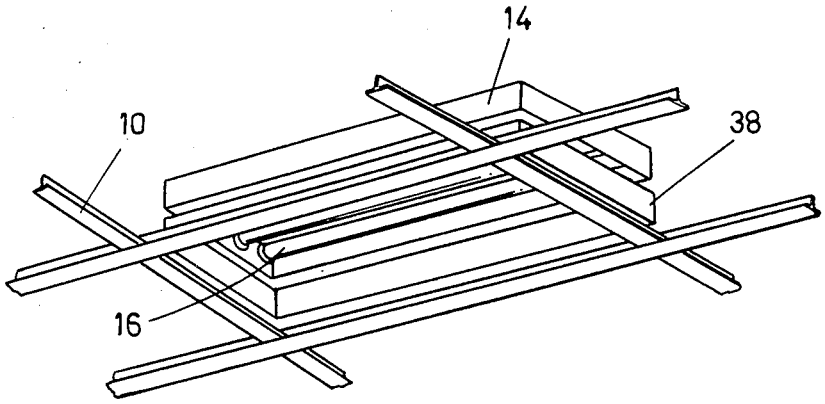
FIG. 5 shows an alternate embodiment.

Such a modification is shown in FIG. 5. In this case continuous extension members 38, replace the separate extension assemblies 20. Members 38 may be attached to the ceiling Tees, and to the side walls of the troffer box in essentially the same way as shown in FIGS. 2, 3 and 4. Alternatively, they can be formed with struck out tongues (not shown) to snap in place.

It will also be appreciated that while the assemblies 20 are shown as two element construction, they could equally well be made of a single component, with suitable clamping formations in the form of spring clips or the like on their lower edges, and suitable support flanges and guidance means on their upper portions, and would thus function in essentially the same way.

In order to reduce the low angle light rays for glare, a lighting louvre indicated generally as 40 is employed. Such louvre 40 consists of a generally rectangular framework 42, and a plurality of criss-cross intersecting baffle members 44, which typically form square or generally rectangular openings somewhat in the manner of an egg crate or carton divider.

The depth of the louvre 40 will be approximately equivalent in the typical case to the height of the extension assemblies 20.

The louvre 40 will typically be provided with retaining spring clips 46, which are designed to snap around the lower portions of the ceiling tees 10 and support the louvre 40 in position.

Typically, the lens 18 will simply be supported above the louvre 40.

In this way the lighting from the tubes 16 is diffused, by the lens 18 and low angle light rays or glare is generally speaking cut off to a very substantial extent by the louvre 40. Thus there will be ample illumination directly beneath the troffer 14 and extending outwardly from the troffer 14 in a predetermined pattern. However low angle light rays which might interfere with the comfort of persons at some distance to one side or end of the troffer 14 will be cut off by the louvre 40.

It will thus be appreciated that the invention provides a simple low cost method of retrofitting standard shallow troffers 14, to provide for the use of louvres 40 to reduce glare.

All of this is done at minimum cost to the building owner or occupier of the space, and without the need for removing existing electrical fittings and replacing them with new ones, and without the need for employing specialized trades people such as electricians and the like who would otherwise be required for retro-fitting the fixtures themselves.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A troffer extension apparatus attachable to the side and end walls of a lighting troffer, and inter-engageable with structural ceiling tee portions of a ceiling system, whereby to raise the troffer relative to the ceiling, and comprising:

a plurality of extension members;

upper engagement means on one end of said members adapted to fit around and inter-engine with the lower edge of the side walls of said lighting troffer;

lower engagement clip portions on the other ends of said members engageable around opposite sides of upwardly directed portions of said ceiling tees; and, fastening means associated with said clip portions for fastening said clip portions together whereby to secure said clip portions to said upwardly directed portions of said ceiling tees.

2. A troffer extension apparatus as claimed in claim 1 including a lighting louvre dimensioned to fit within the dead space provided by said extension members, and releasable clip members on said louvre, whereby the same may be releasably fastened in position.

3. A troffer extension apparatus as claimed in claim 1 wherein said extension members comprise a plurality of separate members adapted to be placed at spaced locations around said troffer side walls.

* * * * *